United States Patent [19]

Wilczewski

[11] Patent Number: 4,489,572

[45] Date of Patent: Dec. 25, 1984

[54] DOUBLE POST EARRING STRUCTURE FOR PIERCED EARS

[76] Inventor: Barbara J. Wilczewski, 1448 E. Second St., Tucson, Ariz. 85716

[21] Appl. No.: 342,966

[22] Filed: Mar. 12, 1982

[51] Int. Cl.[3] ..... A44C 7/00

[52] U.S. Cl. ..... 63/13

[58] Field of Search ..... 63/12, 13, 20, 1, 2; D11/40, 41, 43, 45

[56] References Cited

U.S. PATENT DOCUMENTS

D. 136,958 1/1944 Rubel ..... D11/41

1,115,280 10/1914 Busch ..... 63/2 X

FOREIGN PATENT DOCUMENTS 221673 9/1924 United Kingdom ..... 63/2

OTHER PUBLICATIONS

Esquire, Jun. 1971, (vol. LXXV, No. 6) article beginning on p. 116.

The Washington Post, Apr. 26, 1977, pp. B1 & B3 "Punks without a Cause".

Jeweler's Circular-Keystone, Sep. 1978, p. 120.

*Primary Examiner*—F. Barry Shay

*Attorney, Agent, or Firm*—Henderson & Sturm

[57] ABSTRACT

This invention relates to earrings in general, and more specifically to an improvement in post type earrings for pierced ears, combining two or more post elements operatively connected together to provide a support surface for one or more ornaments designed to be worn on at least one ear.

1 Claim, 7 Drawing Figures

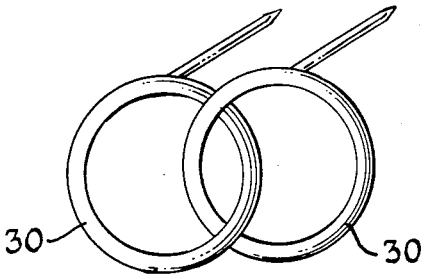
FIG. 4.
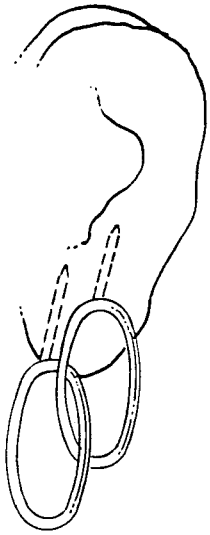
FIG. 5.
FIG. 7.
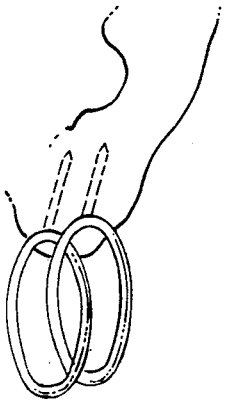
FIG. 6.
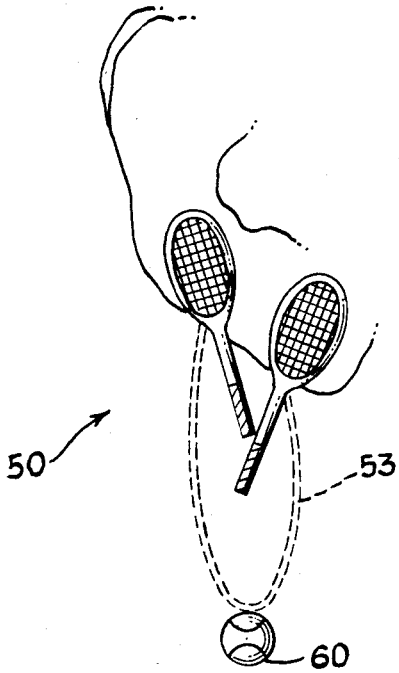

DOUBLE POST EARRING STRUCTURE FOR PIERCED EARS

BACKGROUND OF THE INVENTION

For a typical pair of earrings designed for use with pierced ears, the major problems encountered by the user are; the inability for self expression; lack of individuality; and the inherent ability to lose or misplace one of the set, which in turn renders the remaining earring useless.

Various designs have been developed to promote individuality and self expression. Examples of such prior art devices may be seen by reference to Dweck, U.S. Pat. No. Des. 211,385, and Durante, U.S. Pat. No. Des. 246,357. These prior art devices unfortunately still retain the one earring, one ear, method of display.

Furthermore, while various securing means are employed in this area of technology such as Davis, U.S. Pat. No. 3,831,398, they again rely on the one post, one securing attachment method. These devices, while useful for their immediate purpose, to date have been unimproved.

The present invention on the other hand provides a simple and easily assembled construction which allows the wearer to display a plurality of ornaments or insignia, while also maintaining additional security against the accidental loss of one or more elements of the earrings, plus it enables the user to vary the arrangement of the elements to produce a unique aesthetically pleasing arrangement, and with the increased interest in sports and recreactional activities many people desire to display their favorite pastime in an ornamental fashion.

Such activities can be represented by displaying miniature replicas of a tennis racket and ball, boat and anchor, fishing pole and fish, etc.

Furthermore this invention is particularly well suited for individuals seeking a unique mode of self expression, since the ability to wear, arrange and display different ornaments in a variety of positions such as squares, circles, triangles, etc., in random or prearranged order, on one or both ears, without the fear of losing a part of the combined set, which is an extremely advantageous, worthwhile and desirable feature.

SUMMARY OF THE INVENTION

An object of the present invention is the provision of a new and unique earring arrangement whereby the wearer may customize, stylize, and arrange the individual components to satisfy, express, and establish, their own personality and sense of style.

Another object of the present invention is the provision of an earring structure, which comprises a plurality of interconnected ornamental earring posts, which are inexpensive to manufacture and which can be placed in a wearer's pierced ear lobe with safety, convenience and the assurance that the earrings will remain securely disposed in the ear, with virtually no possibility of loss.

Yet another object of the instant invention is the provision of a double post structure wherein the ornaments which adorn the posts are connected by a flexible, or rigid connection, or a combination thereof.

Still another object of the instant invention is the provision of an earring structure which allows two rigid ornaments to be interconnected, yet spaced varying distances on the wearers ear lobe.

A further object of the present invention is the provision of an earring structure which employs a double post arrangement having a connecting member which acts as a support for an additional ornamental member.

A still further object of the present invention is the provision of an earring structure which will lend itself to displaying in ornamental form, adornments which are representative of the wearers, occupation, or favorite sport or recreational activity.

A yet further object of the instant invention is the provision of an interconnected double post earring structure, wherein by virtue of the connection it is conceivable that one of the posts will become dislodged, but virtually inconceivable that both would become dislodged without the wearer being aware of it, and therefore the probibility of loss will become virtually impossible.

These and other objects, advantages and novel features of the invention will be fully understood when considered in light of the following detailed description of the invention when viewed in conjunction with the accompanying drawings.

BRIEF DESCRIPTION OF THE DRAWINGS

FIG. 4, is a perspective view of the double post earring wherein each decorative element on their respective post is interlocked with each other to form a rigid but adjustable connection.

FIGS. 5 and 6, illustrate how the rigid but adjustable connection in FIG. 4, could be utilized by different people having different spacing between the piercing of each individual ear.

FIG. 7, illustrates how the connection between the double posts can be used to suspend an additional decorative item.

DETAILED DESCRIPTION OF THE PREFERRED EMBODIMENT

Figure 1:
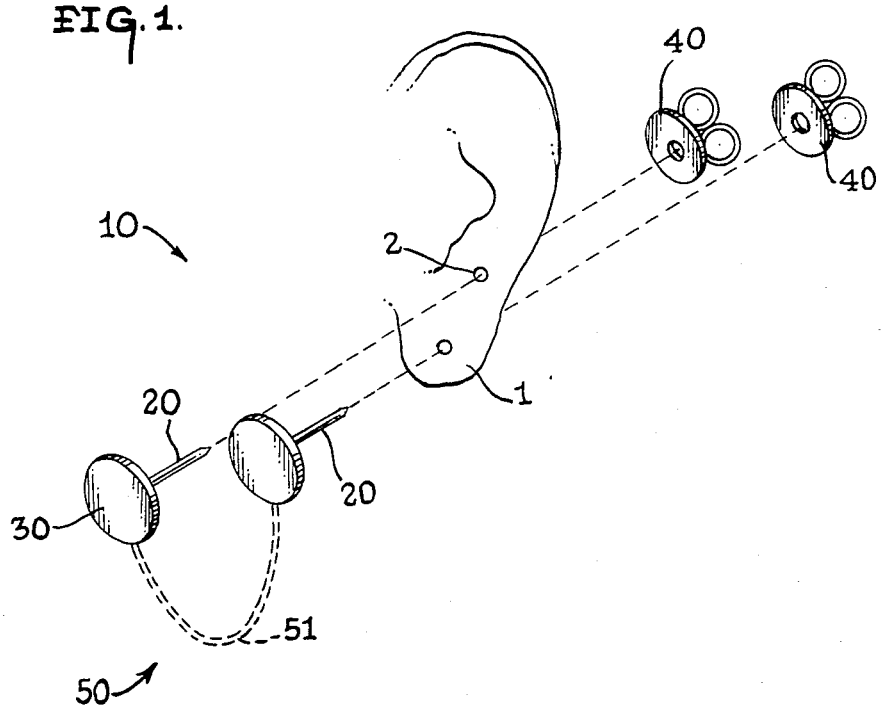
FIG. 1, is an exploded perspective view of the double post earring of the instant invention showing how a typical user would employ it to adorn their ear.

As can be seen by reference to FIG. 1, the present invention, designated generally as 10, is designed for use with a persons earlobe 1, which has a plurality of healed punctures of piercings 2.

In the western world the piercing of ears is a rather common procedure, undertaken for the purpose of enhancing a persons physical appearance, by allowing earrings to be supported within the pierced portion of the individuals earlobe.

It should be appreciated at the outset, that an inherent requirement for the employment of this improved structure demands that the wearer have at least one earlobe pierced, a multiplicity of times, in a plurality of locations.

The improved earring construction 10, comprises a plurality of individual post elements 20, rigidly secured to separate ornamental members 30. The post elements 20 comprise a thin elongated portion 21 secured on one end to an ornamental member 30, and whose free end 22 is dimensioned to be easily inserted through any one of the plurality of pierced portions of the wearers earlobe. The free end 22 of the post element is further dimensioned to be slidingly engaged by any one of a variety of securing mechanisms 40, commonly employed for that purpose, with single post earrings.

So far we have merely discribed the structure of most single post earrings; however, this invention contemplates a radical departure from the arrangement, in that the ornamental member 30 mentioned supra, are interconnected in a variety of ways, and each ornamental member 30 has its own post 20 and securing means 40.

Figure 2:
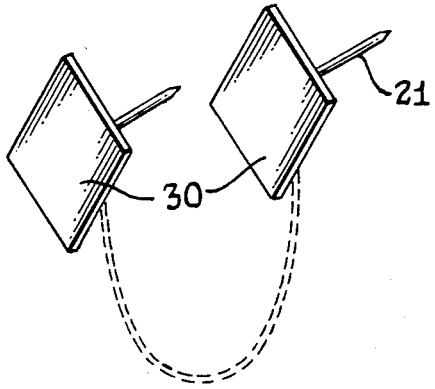
FIG. 2, is a perspective view of the double post earring being joined by a flexible connector.

As can best be seen in FIG. 2, in one form of the preferred embodiment the two ornamental members 30 are interconnected by an elongated connecting member 50, in the form of a thin flexible element 51. The flexible element 51 in this case is a thin chain; however, any flexible elongated structure would suffice, as long as it was secured on either end to a respective ornamental member 30 or its associated post 20, to form the permanent or releasable interconnection between the respective structures.

Figure 3:
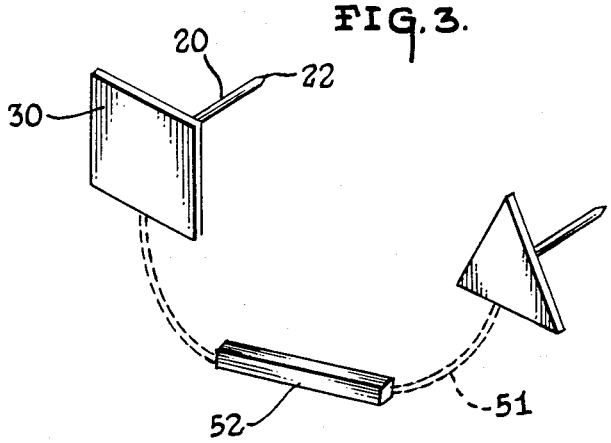
FIG. 3, is a perspective view of the double post earring being joined by a combined rigid and flexible connector.

FIG. 3, illustrates another form of the preferred embodiment in which the connecting member 50 comprises a plurality of flexible elements 51, which support an intermediate rigid element 52 to form the elongated connecting member 50 which interconnects the ornamental member 30.

FIGS. 4 thru 6, illustrate a variation of the preferred embodiment, wherein the ornamental member 30 themselves form the interconnection between themselves. In this embodiment the ornamental members 30 are formed in an interlocking arrangement, yet they are dimensioned to move relative to one another within given boundaries. It should be fully appreciated at this point that the invention contemplates both geometric and non-geometric shapes fabricated in an interlocking manner similar to that illustrated in FIG. 4. It should also be appreciated that the purpose of fabricating the ornamental members so that they can be moved relative to one another is to accommodate non-uniformity in the distances between the plurality of piercings of the wearer's earlobe. This expansibility, so to speak, is clearly illustrated in FIGS. 5 and 6, which shows the ornamental members 30 disposed at various distances with respect to one another on different earlobes.

A final form of the preferred embodiment is illustrated in FIG. 7, wherein the elongated connecting member 50, forms a support surface 53 which is adapted to support an additional adornment or ornamental member 60.

Having described the basic structure involved in this invention it should be apparent that the ornamental members 30 and additional adornment 60 can take any shape, form, configuration or design conceivable, to represent for example; geometric and non-geometric patterns, animate and inanimate objects, representations of professions and recreational activities, to name but a few.

The shape or design of the ornaments and adornments are ancillary to the invention, which essentially comprises an interconnected double post and securing arrangement for earrings, to be used by persons having a plurality of pierced areas on at least one of their ears.

Having thereby disclosed the subject matter of this invention, it should be obvious that many modifications, substitutions and variations of the invention are possible in light of the above teachings. It is therefore to be understood, that the invention may be practised other than as specifically described, and should be limited only by the breadth and scope of the appended claims.

I claim:

1. An improved earring construction for people having a plurality of spaced apart pierced holes in at least one of their earlobes, wherein the earring construction comprises:

a plurality of post members;

a plurality of rigid, interlocked and relatively moveable ornamental members directly connected to one another and to said post members; and a plurality of securing mechanisms adapted to secure the said plurality of rigid interlocked ornamental members to said plurality of post members, in the said plurality of spaced apart pierced holes in said one earlobe; wherein the relative movement, permissible between said rigid interlocked ornamental members, allows the earring construction to be employed where the spacing between the pierced holes varies from person to person.

* * * * *